US005086833A

United States Patent [19]

Ben-Dosa

[11] Patent Number: 5,086,833

[45] Date of Patent: Feb. 11, 1992

[54] CLEANING SYSTEM FOR CLEANING FLUID-CONDUCTING TUBING

[75] Inventor: Chaim Ben-Dosa, Herzlia, Israel

[73] Assignee: Balls-Technique Ltd., Herzlia, Israel

[21] Appl. No.: 686,359

[22] Filed: Apr. 17, 1991

[30] Foreign Application Priority Data

May 4, 1990 [IL] Israel ..... 94289

[51] Int. Cl.[5] ..... F28G 1/12

[52] U.S. Cl. ..... 165/95; 151/3.51

[58] Field of Search ..... 165/95; 15/3.5, 3.51

[56] References Cited

U.S. PATENT DOCUMENTS

| | | | |
|---|---|---|---|
| 4,234,993 | 11/1980 | Kintner | 165/95 |
| 4,283,807 | 8/1981 | Bizard | 165/95 |
| 4,385,660 | 5/1983 | Koller | 165/95 |
| 4,435,285 | 3/1984 | Okouchi et al. | 165/95 |
| 4,447,925 | 5/1984 | Riedel | 165/95 |
| 4,468,930 | 9/1984 | Johnson | 165/95 |
| 4,544,027 | 10/1985 | Goldberg et al. | 165/95 |
| 4,620,589 | 11/1986 | Koller | 165/95 |
| 4,865,121 | 9/1989 | Ben-Dosa | 165/95 |
| 4,984,629 | 1/1991 | Voith et al. | 165/95 |

FOREIGN PATENT DOCUMENTS

| | | | |
|---|---|---|---|
| 152407 | 11/1981 | Fed. Rep. of Germany | 165/95 |
| 2501358 | 9/1982 | France | 165/95 |

*Primary Examiner*—John Rivell
*Assistant Examiner*—L. R. Leo
*Attorney, Agent, or Firm*—Benjamin J. Barish

[57] ABSTRACT

A cleaning system for cleaning tubing by means of balls circulated with the fluid through the tubing includes a separator having a grid structure in a separator conduit, and an arrangement to move balls tending to accumulate on the upstream face of the grid structure towards a ball outlet at the separator conduit where they may be more effectively drawn into a recirculating conduit by a negative pressure at the inlet thereof.

17 Claims, 7 Drawing Sheets

CLEANING SYSTEM FOR CLEANING FLUID-CONDUCTING TUBING

FIELD AND BACKGROUND OF THE INVENTION

The present invention relates to a cleaning system for cleaning fluid-conducting tubing. The invention is particularly useful in the cleaning system described in our U.S. Pat. No. 4,865,121, and is therefore described below with respect to such a system, but it will be appreciated that the invention could advantageously be used in other cleaning systems as well.

The cleaning system described in U.S. Pat. No. 4,865,121 is particularly useful for cleaning the tubing of heat exchangers used in condensers and the like by means of circulating with the fluid a plurality of rubber balls which are slightly larger in diameter than the tubing so that they are compressed as they travel the length of the tubing, thereby keeping the tubing walls clean and free from deposits. Such cleaning systems include a plurality of balls circulated with the fluid through the tubing from the upstream side to the downstream side of the tubing, recirculating means having an inlet at a negative fluid pressure at the downstream side of the tubing, and an outlet at a positive pressure at the upstream side of the tubing for recirculating the balls through the tubing, and separator means between the downstream side of the tubing and the recirculating means for separating the balls from the fluid. The separated balls are directed to the upstream side of the tubing, whereas the fluid, after the balls have been separated therefrom, is directed to an outlet fluid line.

U.S. Pat. No. 4,865,121 was directed mainly to a novel recirculating means for use in such a cleaning system. The invention of the present application is directed primarily to a novel separator means for separating the balls from the fluid before the balls are recirculated through the tubing.

BRIEF SUMMARY OF THE INVENTION

According to the present invention, such separator means includes a conduit having an inlet connected to the downstream side of the tubing, a ball outlet connected to the inlet of the recirculating means, and a fluid outlet connected to an outlet fluid line; a grid structure within the conduit having an upstream face facing the conduit inlet and ball outlet, and a downstream face facing the fluid outlet, for separating the balls from the fluid and for directing the separated balls to the recirculating means; and ball freeing means comprising first and second blocking devices cooperable with separate parts of the grid structure and effective, during a ball freeing operation, to shift the bulk of the fluid flow through the fixed grid structure towards the ball outlet of the separator conduit to thereby move balls tending to accumulate on the upstream face of the grid structure towards the ball outlet where they may be more effectively drawn into the recirculating means by the negative pressure at the inlet of the recirculating means.

According to further features in the preferred embodiment of the invention described below, the fixed grid structure includes a first grid extending across a part of the interior of the conduit and defining a first flowpath to the conduit outlet, and a second grid extending across another part of the interior of the conduit and defining a second flowpath to the conduit outlet, in parallel to the first flowpath. The first blocking device in the ball freeing means is movable to a blocking position to block the fluid flow through the first grid during a ball freeing operation, or to an unblocking position to unblock the fluid flow through the first grid during a normal cleaning operation; and the second blocking device is movable to a blocking position to block the fluid flow through the second grid during a normal cleaning operation, or to an unblocking position to unblock the second grid during a ball freeing operation.

According to still further features in the described preferred embodiment, the second grid includes a fixed comb having a plurality of spaced teeth extending across the interior of the conduit, and the second blocking device includes a pivotal comb having a plurality of spaced teeth movable, when in its blocking position, in the spaces between the teeth of the fixed comb, and out of the spaces when in its unblocking position.

According to still further features in the described preferred embodiment, the fixed comb includes a first section and a second section closer to the ball outlet than the first section; and wherein the pivotal comb includes a first section cooperable with the first section of the fixed comb to block the flow therethrough during a normal cleaning operation, but to block the flow therethrough during a ball freeing operation, and a second section cooperable with the second section of the fixed comb to permit the flow therethrough via a third flowpath to the output fluid line during a normal cleaning operation, but to block the flow therethrough during at least a part of a ball freeing operation.

As will be described more particularly below, the separator means constructed in accordance with the foregoing features enables the balls, tending to accumulate on the upstream face of the separator grid within the conduit, to be freed by executing a ball freeing operation wherein the flowpath of the fluid is changed during a sequence of steps so as to gradually move the balls, accumulating on the upstream face of the separator grid, towards the ball outlet of the separator conduit, and thereby to enable the negative pressure thereat to draw them out through the ball outlet into the recirculating means.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
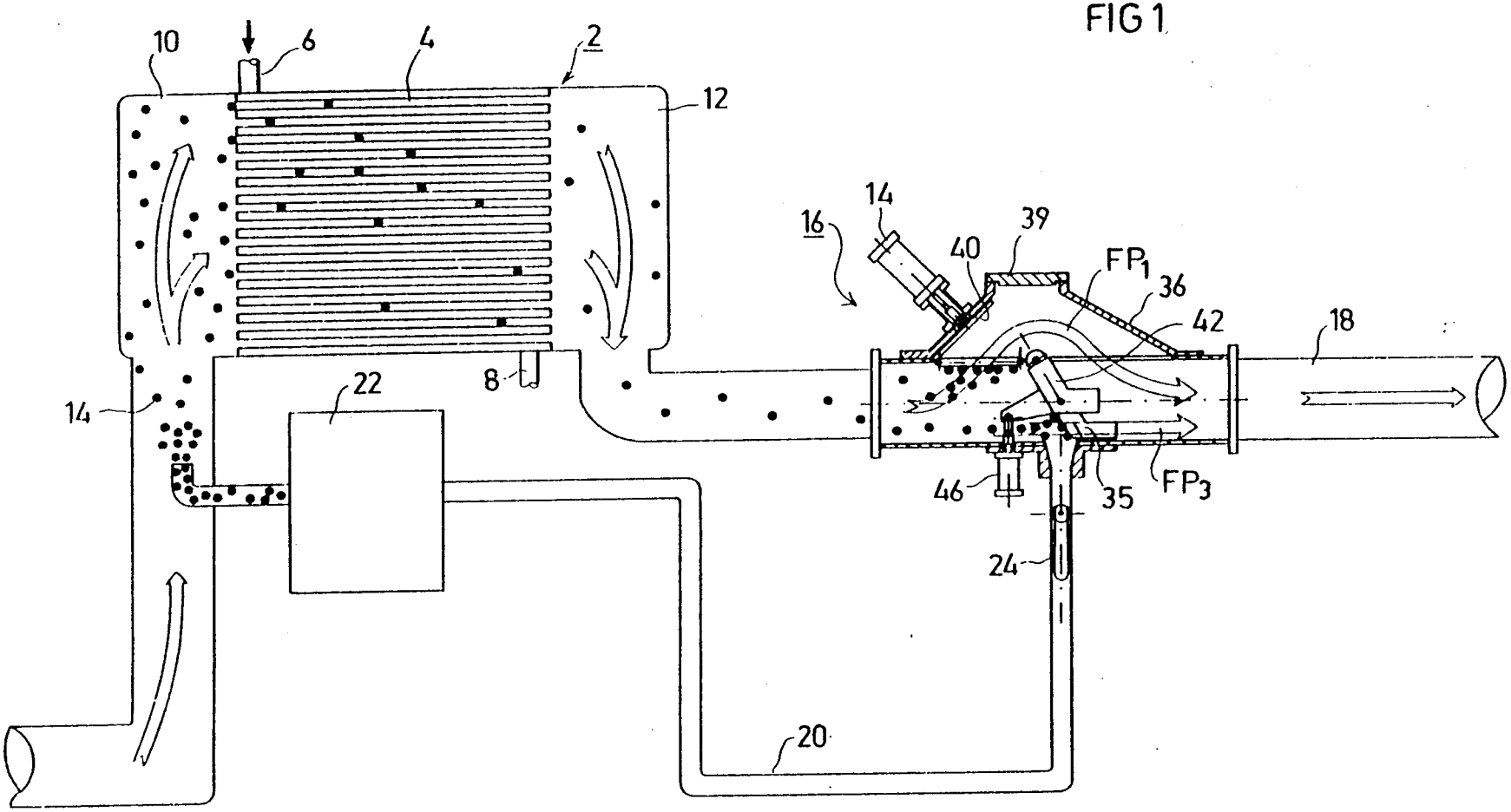
FIG. 1 illustrates one form of cleaning system for fluid-conducting tubing constructed in accordance with the present invention.

With reference to FIG. 1, there is illustrated a system including a condenser, generally designated 2, having tubing 4 in the form of a plurality of parallel, spaced tubes through which the cooling fluid, such as cooling water, is passed in order to condense a fluid, such as steam or a refrigerant gas, circulated from an inlet 6 through the spaces between the condenser tubing 4 to an outlet 8. The cooling liquid is circulated through the condenser tubing from an inlet header 10 at the upstream side of the condenser tubing to an outlet header 12 at the downstream side.

In order to prevent the lodging or settling of particles within the condenser tubing 4, which would tend to clog or erode the tubing, the cooling liquid includes a plurality of cleaning balls 14 forced through the tubing 4 with the cooling liquid. Balls 14 are slightly larger in diameter than the condenser tubes 4 so that they rub against the inner walls of the tubes and thereby maintain them clean. Thus, any solid particles suspended in the cleaning liquid are kept moving and not allowed to settle, thereby preventing clogging of the tubes. This technique of using cleaning balls for cleaning the tubing in condensers and other forms of heat-exchangers is well-known, and therefore further details of such a cleaning system, or of the balls 14 used in this type of system, are not set forth herein.

The illustrated cleaning system includes a separator assembly, generally designated 16, at the downstream side of the tubing 4 for separating the balls from the fluid before the fluid is fed to an outlet fluid line 18. The separated balls are directed by the separator assembly 16 via a conduit 20 to a recirculating means 22 which feeds the balls 14 to the inlet header 10 for recirculation through the tubing 4.

In the conventional construction, recirculation means 22 uses a continuously driven pump which produces a negative pressure in conduit 20 for drawing the balls from the separator assembly 16, and a positive pressure for positively feeding the balls back into the inlet header 10. Our U.S. Pat. No. 4,865,121 discloses another form of recirculation means having advantages over the conventional continuously-driven pump recirculating the balls. In this case also, a negative pressure is produced in conduit 20 for drawing the separated balls from the separator assembly 16, and a positive pressure is produced at the outlet end of the recirculation end for positively feeding the balls into the inlet header 10. Conduit 20, through which the balls are fed through the recirculating means, may include a valve 24 which is open whenever it is desired to recirculate the balls back to the inlet header 10.

The present invention is directed to the separator assembly 16, and particularly to an improved construction which permits the balls, tending to accumulate on the upstream side of a grid in the separator assembly, to be freed and to be caused to move towards the recirculation conduit 20 by executing a ball freeing operation.

Figure 2:
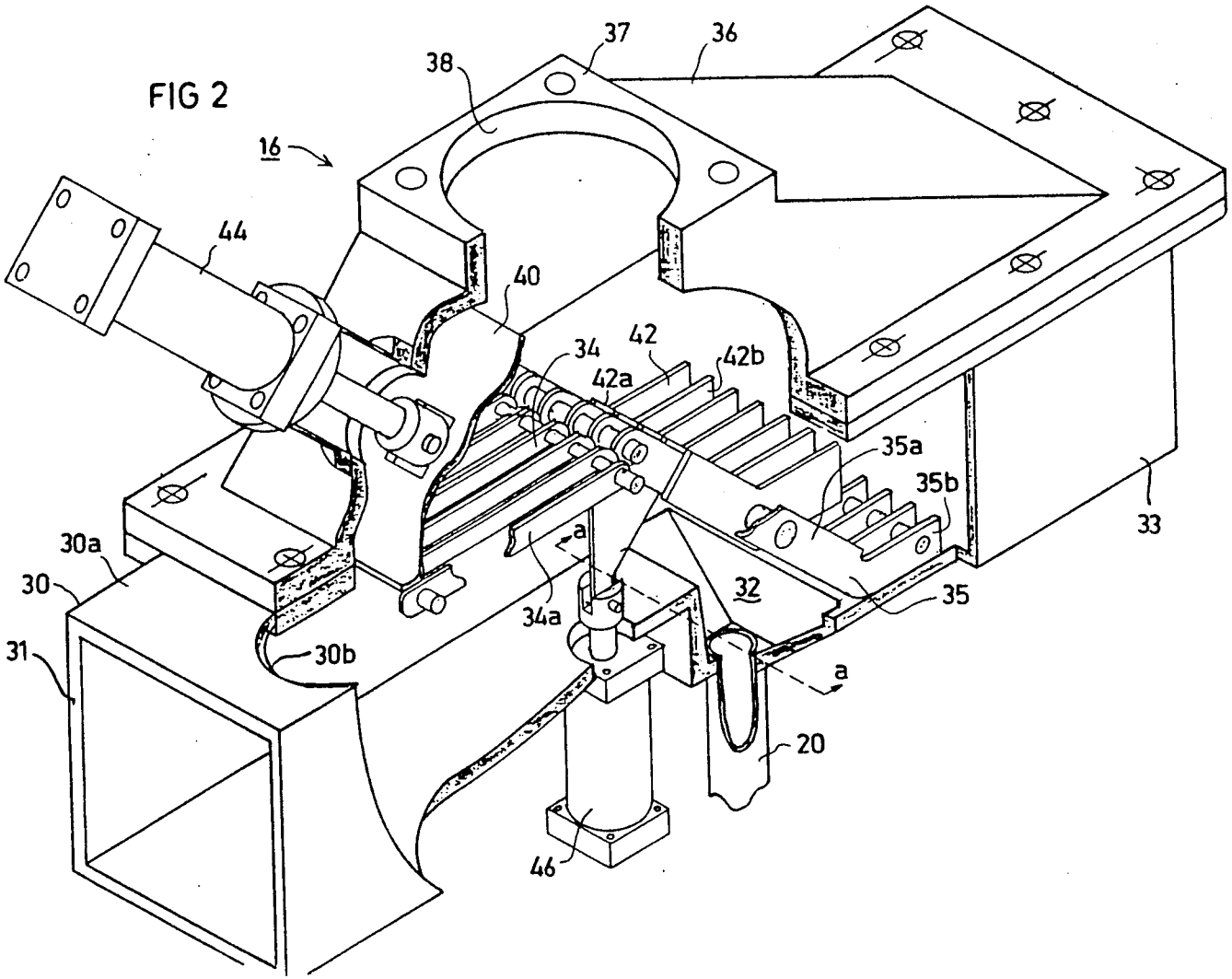
FIG. 2 is a three-dimensional view more particularly illustrating the separator means in the cleaning system of FIG. 1.
Figure 2A:
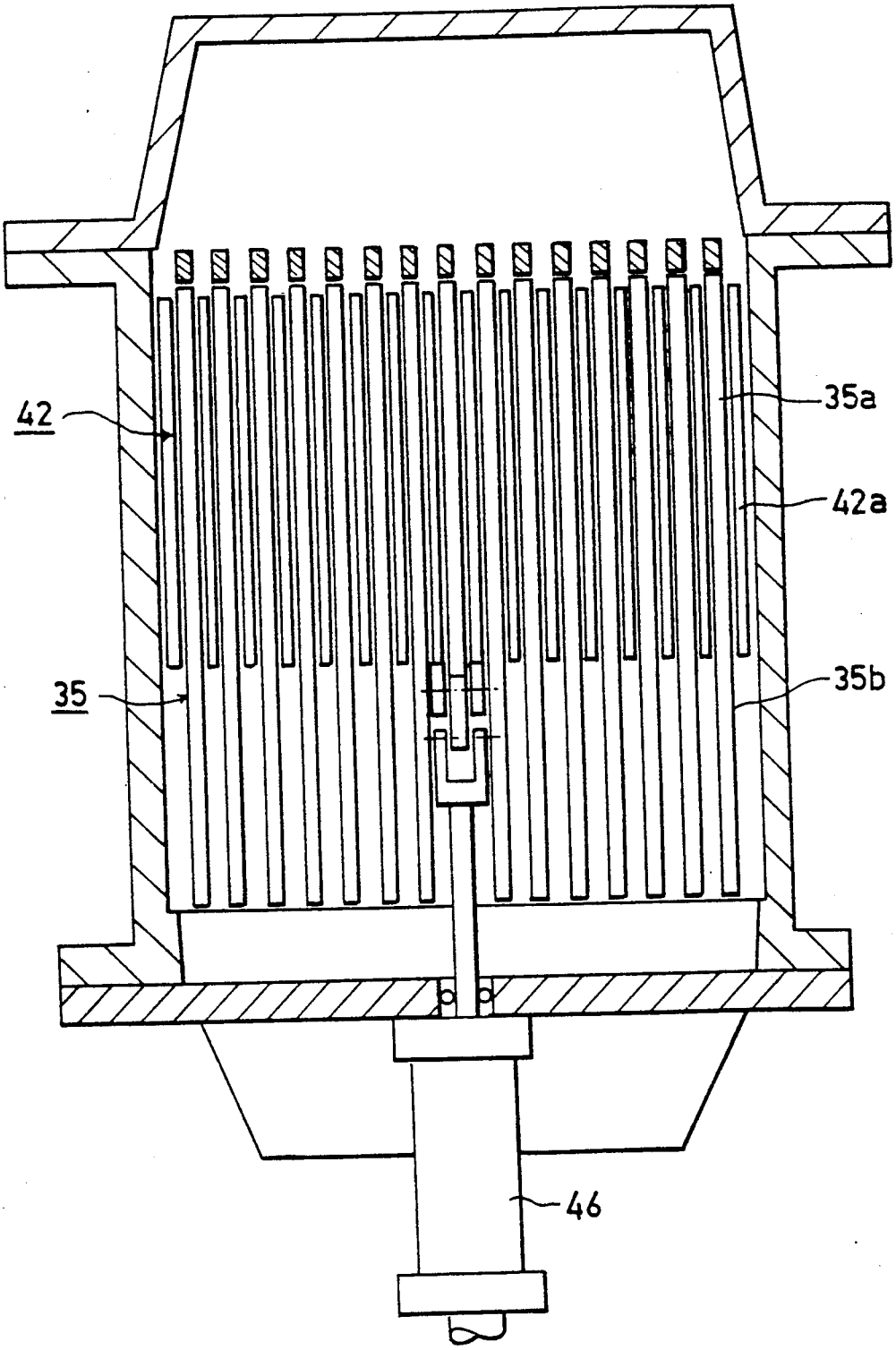
FIG. 2*a* is a sectional view along line a—a of FIG. 2.
Figure 3:
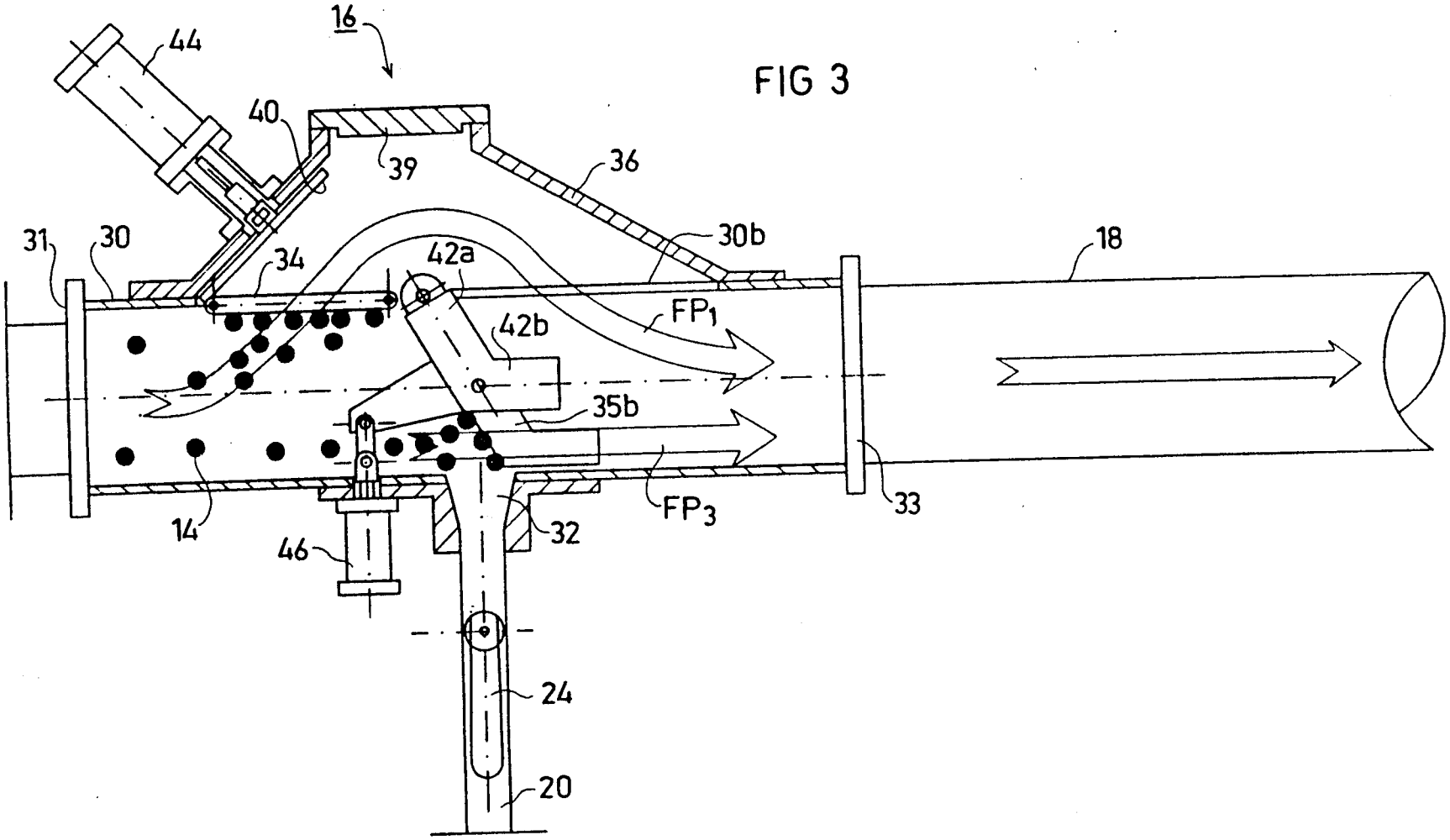
FIG. 3 is an enlarged view illustrating the flowpaths in a normal cleaning operation.

The construction of separator assembly 16 is more particularly illustrated in FIGS. 2, 2*a* and 3. Thus, it includes a conduit, generally designated 30, having an inlet 31 connected to header 12 at the downstream side of the tubing 4, a ball outlet 32 connected to the inlet of the recirculating means 22 via conduit 20, and a fluid outlet 33 connected to the fluid outlet line 18. Conduit 30 further includes a separator grid structure, constituted of a first fixed grid 34 and a second fixed grid in the form of a fixed comb 35 having upstream faces facing the inlet 31 and ball outlet 32, and downstream faces facing the fluid outlet 33, for separating the balls from the fluid flowing through the separator conduit. The balls are directed through the ball outlet 32 at the upstream sides of the fixed grid 34 and fixed comb 35, whereas the fluid (e.g., water) flowing through the fixed grid 34 and fixed comb 35 is directed via outlet 33 to the fluid outlet line 18.

The structure of fixed grid 34 is best seen in FIG. 2, wherein it will be seen that it includes a plurality of bars 34*a* spaced from each other a distance slightly less than the diameter of the balls 14, so as to block the flow of the balls therethrough. The fixed comb 35, as best seen in FIG. 2*a*, is constituted of an upper inclined section 35*a* and a lower horizontal section 35*b*, each including a plurality of teeth also spaced from each other a distance slightly smaller than the diameter of the balls 14, so as also to block the flow of the balls therethrough.

Since the balls 14 are of rubber and are generally only slightly larger in diameter than the spacing between the teeth in grid 34 and comb 35, they tend to stick to the upstream faces of these members. While a negative pressure is applied to the ball outlet 32, as described earlier, the upstream face of grid 34 is at a significant distance from the ball outlet 32, so that the negative pressure at the ball outlet is not always sufficient to draw the balls from the grid to the ball outlet.

The illustrated separator assembly 16 therefore includes ball freeing means effective, during a ball freeing operation, to shift the bulk of the fluid flow through the fixed grid structure, particularly grid member 34, towards the ball outlet 32. This operation thereby moves the balls tending to accumulate on the upstream face of the grid 34 towards the ball outlet where they are more effectively drawn into conduit 20 leading to the recirculating means 22 by the negative pressure at the ball outlet 32.

Conduit 30 is of rectangular section. Its upper wall 30*a* is formed with an opening 30*b* communicating with an extension 36 of pyramidal configuration and terminating in a rectangular top wall 37 formed with a circular opening 38 closed by a removable cover 39 permitting access into the interior of extension 36. The fixed grid 34 is fixed within opening 30*b* of the top wall 30*a* and extends for the complete surface area of opening 30*b*.

Accordingly, a first flowpath, shown by arrow $FP_1$ (FIGS. 1 and 3), is produced through the separator assembly; this flowpath passes through grid 34 and the extension 36 and is effective during a normal cleaning operation. A second flowpath $FP_2$, shown in FIG. 4*a*, is established through the upper section 35*a* of the fixed comb 35 during a ball freeing operation; and a third flowpath, shown at $FP_3$, is established through the lower section 35*b* of the fixed comb 35 during a normal cleaning operation, and during a part of the ball freeing operation, as will be described more particularly below.

The ball freeing means comprises a first blocking device 40 cooperable with the fixed grid 34, and a second blocking device 42 cooperable with the fixed comb 35.

Figure 4A:
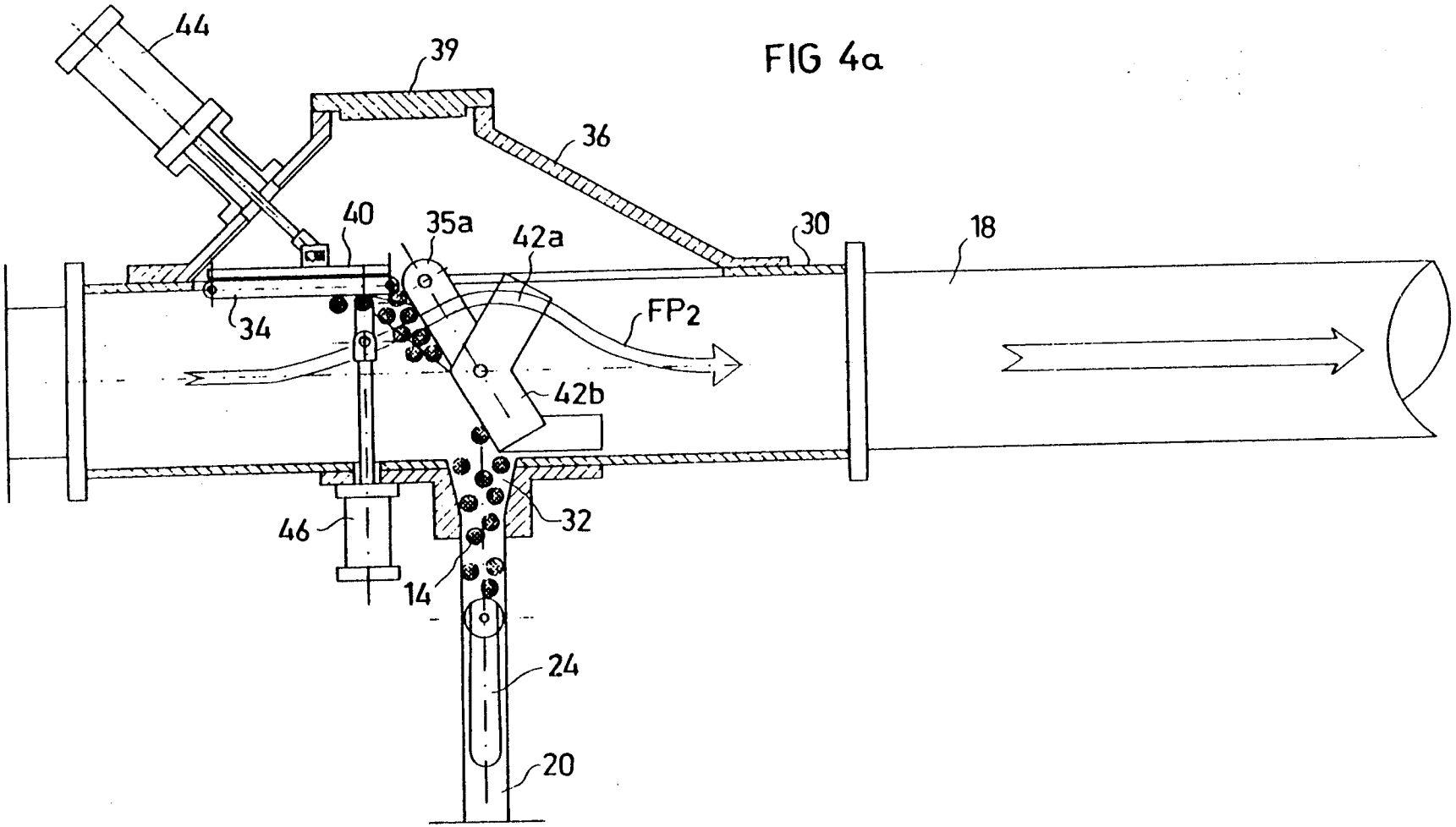
FIGS. 4*a*–4*c* illustrate the flowpaths through three sequential phases during a ball freeing operation.

Blocking device 40 is in the form of a closure plate pivotally mounted along one side of the grid 34 at its downstream face and is pivotal by a piston 44 either to an open, unblocking position as illustrated in FIGS. 2 and 3, or to a closed, blocking position as illustrated in FIG. 4*a*. Closure plate 40 is in its open position during a normal cleaning operation, so as to permit the bulk of the fluid to flow via flowpath $FP_1$ through the separator assembly. However, during a ball freeing operation, closure plate 40 is pivoted to its closed position blocking the flow through the grid 34 and flowpath $FP_1$.

The second blocking device 42 is in the form of a comb pivotally mounted with respect to the fixed comb 35 by means of a piston 46. Pivotal comb 42 also includes a plurality of teeth, as the fixed comb 35, but the teeth in comb 42 are aligned with the spaces between the teeth in comb 35, so that when comb 42 is pivoted in alignment with fixed comb 35, it substantially blocks the passage of the fluid through that comb.

Actually, comb 42 includes two sections 42*a*, 42*b* disposed at an angle to each other. During a normal cleaning operation, as illustrated in FIG. 3, the upper section 42*a* of pivotal comb 42 is in alignment with the upper section 35*a* of the fixed comb 35, so that the flow of fluid via flowpath $FP_2$ (shown in FIG. 4*a*) is substantially blocked. However, the lower section 42*b* of pivotal comb 42 is out of alignment with the lower section 35*b* of the fixed comb 35, so that in this normal cleaning operation, flowpath $FP_3$ is open to the flow of fluid through the separator assembly.

The illustrated cleaning system operates as follows:

During a normal cleaning operation, as illustrated in FIG. 3, closure plate 40 is normally open, thereby establishing flowpath $FP_1$ for the flow of the bulk of the fluid through the separator assembly 16. In addition, pivotal comb 42 is in its normal condition with the upper section 42*a* of the pivotal comb in alignment with the upper section 35*a* of the fixed comb 35, and with the lower section 42*b* of the pivotal comb out of alignment with the lower section 35*b* of the fixed comb 35. Accordingly, during the normal cleaning operation, flowpath $FP_2$ through the upper section of the fixed comb 35 is blocked, but flowpath $FP_3$ through the lower section of the fixed comb is open.

It will thus be seen that during a normal cleaning operation, the bulk of the fluid (e.g., water) will flow through the separator assembly via flowpath $FP_1$ and some through flowpath $FP_3$, as shown in FIG. 3, whereby the fixed grid 34 and the lower part 35*b* of the fixed comb 35 separate the balls from the fluid. The so-separated balls are drawn to the ball outlet 32 by the negative pressure at that outlet, and are fed via conduit 20 to the recirculating means 22 back to the inlet header 10.

However, the balls tend to accumulate on the upstream faces of the fixed grid 34 and the lower 35*b* section of the fixed comb 35. Whenever desired, which can be done periodically or aperiodically, a ball freeing operation may be performed in order to free the so-accumulating balls and to direct them towards the ball outlet 32, so that the negative pressure at that outlet will be more effective to draw the balls to the recirculating means 22.

Figure 4B:
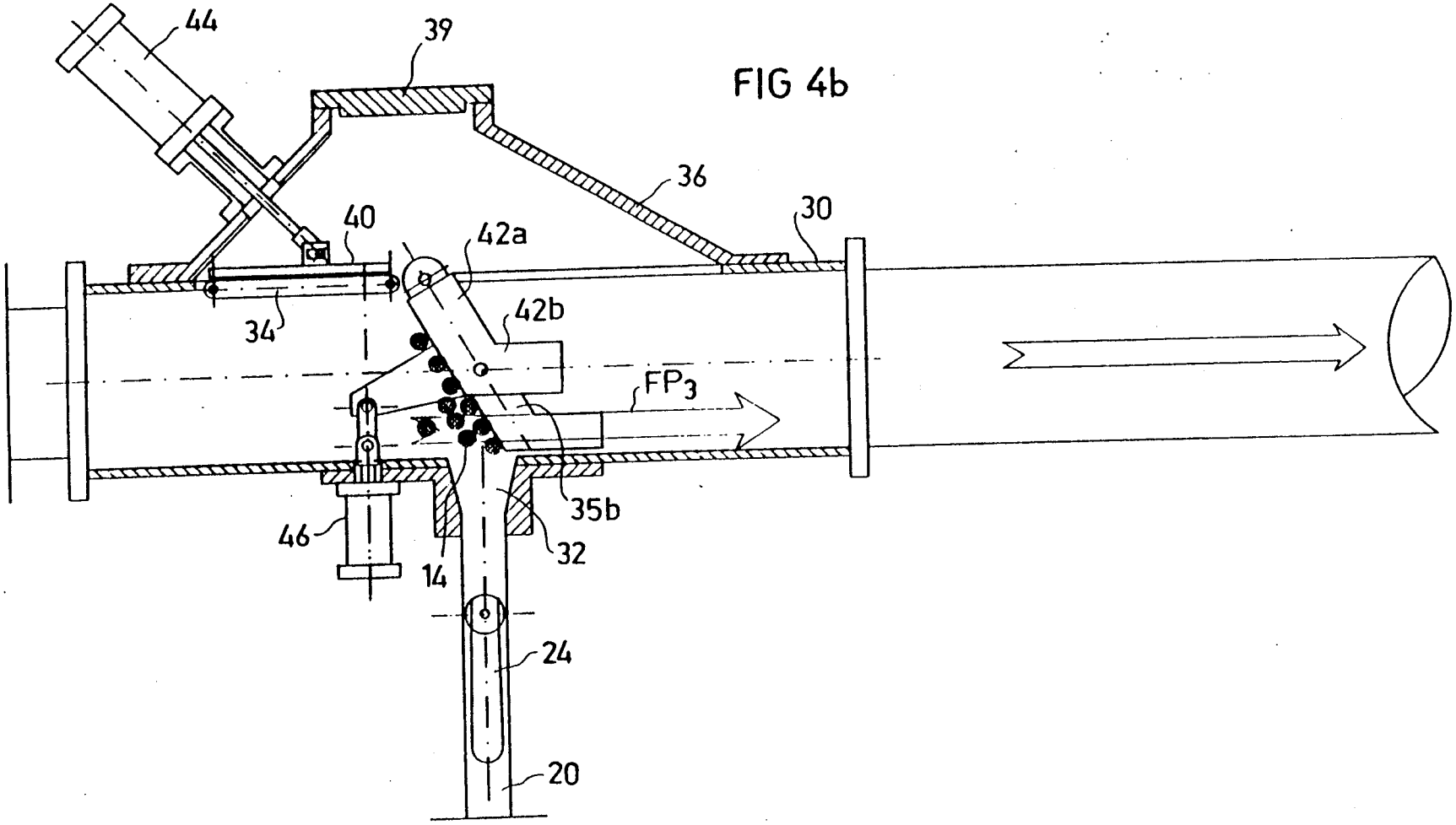
Figure 4C:
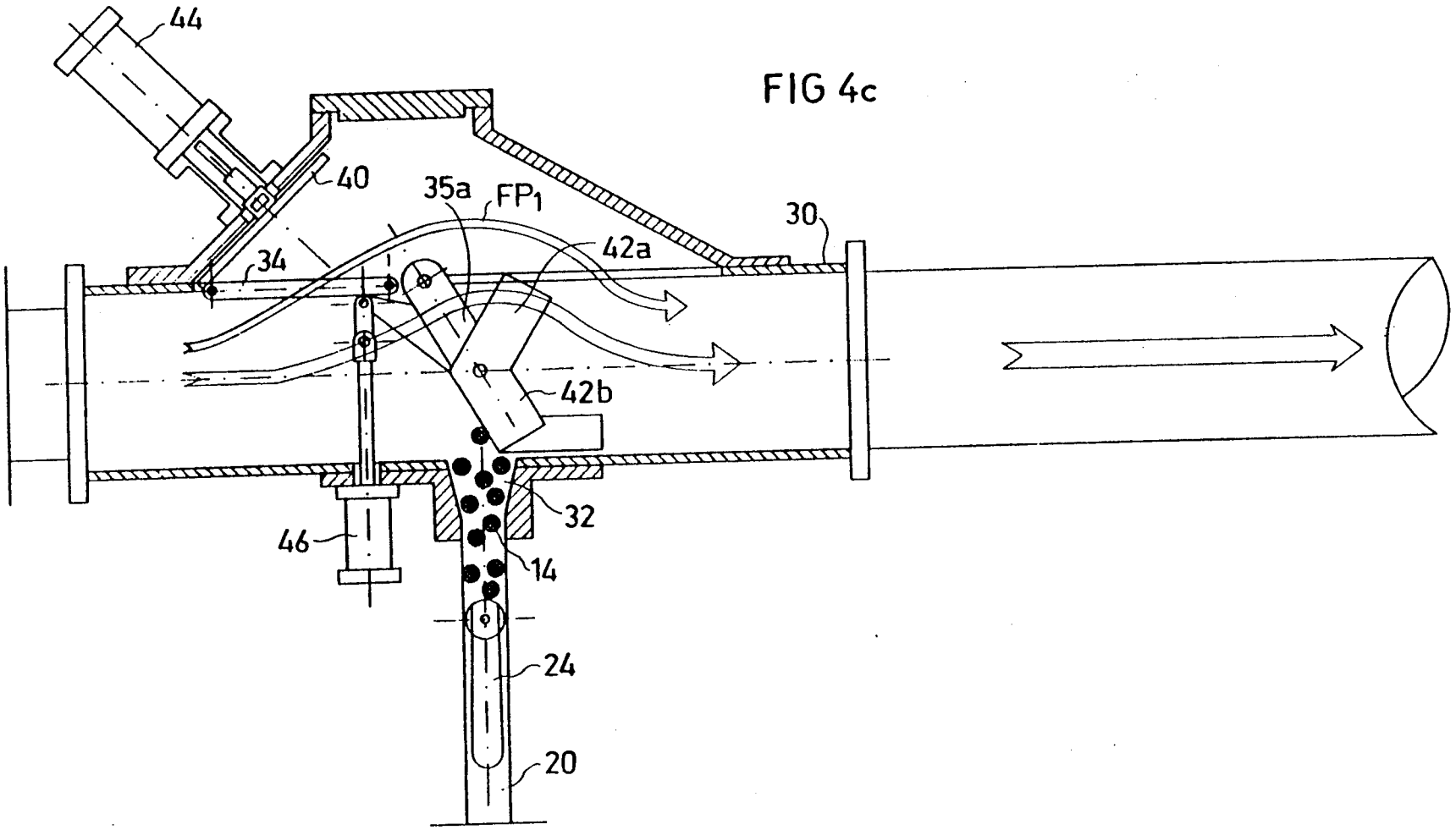

FIGS. 4*a*–4*c* illustrate the three stages of a ball freeing operation.

The first stage, as shown in FIG. 4*a*, is affected by actuating piston 44 to move closure plate 40 to its closed position closing the fixed grill 34. During this first stage, piston 46 is also actuated to pivot pivotal comb 42 to the position illustrated in FIG. 4*a*, wherein its upper section 42*a* is moved out of alignment with the upper section 35*a* of the fixed comb 35, and its lower section 42*b* is moved into alignment with the lower section 35*b* of the fixed comb. This actuation of closure plate 34 interrupts flowpath $FP_1$. This actuation of pivotal comb 42 moves the lower section 42*b* of the pivotal comb into the space between the teeth of the fixed comb section 35*b* and thereby interrupts flowpath $FP_3$, and moves the upper section 42*a* of the pivotal comb 42 away from the teeth of the upper section 35*a* of the fixed comb to open flowpath $FP_2$.

Accordingly, the fluid can still flow through the separator assembly 16, but now through the upper section of the fixed comb 35. Thus, any balls which tended to accumulate on the upstream surface of the fixed grid 34 are now moved to the upstream surface of the upper section 35*a* of the fixed comb 35, i.e., closer to the ball outlet 32 under negative pressure, whereas the balls that tended to accumulate on the upstream surface of the lower section 35*b* of the fixed comb 35 are more effectively drawn by the negative pressure into the ball outlet 32.

After a short time, e.g., a few seconds, piston 46 is then actuated to pivot the pivotal comb 42 back to its initial position, as shown in FIG. 4*b*, wherein its upper section 42*a* comes into alignment with the upper section 35*a* of the fixed comb 35, thereby interrupting flowpath $FP_2$. At the same time, lower section 42*b* of the pivotal comb 42 moves out of alignment with the lower section 35*b* of the fixed comb 35, thereby reopening flowpath $FP_3$. Accordingly, the balls that tended to accumulate on the upstream face of the upper section 35*a* of the fixed comb 35, are now moved by the fluid flow downwardly to the upstream surface of the lower section 35*b* of fixed comb 35, i.e., closer to the ball outlet 32, where they are more effectively drawn by the negative pressure at that outlet.

After another short interval, e.g., a few seconds, piston 46 is then actuated to again pivot the pivotal comb 42 to its actuated position, as shown in FIG. 4*c*, wherein its lower section 42*b* moves into alignment with the lower section 35*b* of the fixed comb 35, thereby interrupting flowpath $FP_3$. The balls that tended to accumulate on the upstream face of the lower fixed comb section 35*b* are thus more effectively drawn by the negative pressure to the ball outlet 32.

The ball freeing operation is terminated by pivoting closure plate 40 to its open position and by pivoting pivotal comb 42 to its initial position, both as shown in FIG. 3, whereupon the cleaning system performs a normal cleaning operation until another ball freeing operation is initiated as described above.

While the invention has been described with respect to one preferred embodiment, it will be appreciated that many variations, modifications and other applications of the invention may be made.

What is claimed is:

1. A cleaning system for cleaning fluid-conducting tubing comprising:

a plurality of balls circulated with the fluid through the tubing from an upstream side to a downstream side of the tubing;

recirculating means having an inlet at a negative fluid pressure at the downstream side of the tubing, and an outlet at a positive fluid pressure at the upstream side of the tubing for recirculating the balls through the tubing;

and separator means for separating the balls from the fluid before recirculated by said recirculating means; said separator means comprising:

a conduit having an inlet connected to the downstream side of the tubing, a ball outlet connected to the inlet of the recirculating means, and a fluid outlet connected to an outlet fluid line;

a grid structure within said conduit having an upstream face facing said conduit inlet and ball outlet, and a downstream face facing said fluid outlet, for separating the balls from the fluid and for directing the separated balls to said recirculating means;

and ball freeing means comprises first and second blocking devices cooperable with separate parts of said grid structure and effective, during a ball freeing operation, to shift the bulk of the fluid flow through the grid structure towards the ball outlet of said separator conduit to thereby move balls tending to accumulate on the upstream face of said grid structure towards said ball outlet where they may be more effectively drawn into said recirculating means by the negative pressure at the inlet of the recirculating means.

2. The cleaning system according to claim 1, wherein:

said grid structure includes a first grid extending across a part of the interior of the conduit and defining a first flowpath to said conduit outlet, and a second grid extending across another part of the interior of the conduit and defining a second flowpath to said conduit outlet in parallel to said first flowpath;

and wherein said first blocking device is movable to a blocking position to block the fluid flow through said first grid during a ball freeing operation, or to an unblocking position to unblock the fluid flow through said, first grid during a normal cleaning operation; and said second blocking device is movable to a blocking position to block the fluid flow through said second grid during a normal cleaning operation, or to an unblocking position to unblock the second grid during a ball freeing operation.

3. The system according to claim 2, wherein said first blocking device is a closure plate pivotal at one side of said first grid either to an unblocking position or to a blocking position with respect thereto.

4. The system according to claim 2, wherein said second grid includes a fixed comb having a plurality of spaced teeth extending across the interior of the conduit, and said second blocking device includes a pivotal comb having a plurality of spaced teeth movable, when in its blocking position, into the spaces between the teeth of the fixed comb, and out of said spaces when in its unblocking position.

5. The system according to claim 4, wherein:

said fixed comb includes a first section and a second section closer to said ball outlet than said first section;

and wherein said pivotal comb includes a first section cooperable with said first section of the fixed comb to block the flow therethrough during a normal cleaning operation, but to permit the flow therethrough during a ball freeing operation, and a second section cooperable with the second section of the fixed comb to permit the flow therethrough via a third flowpath to the output fluid line during a normal cleaning operation, but to block the flow therethrough during at least a part of a ball freeing operation.

6. The system according to claim 5, wherein said first blocking device and said movable comb are controlled such that:

(a) during a normal cleaning operation, the first blocking device is in its unblocking position with respect to said first grid, the first section of the pivotal comb is in a blocking position with respect to the first section of the fixed comb, and the second section of the pivotal comb is in an unblocking position with respect to the second section of the fixed comb, whereby the fluid flows from the separator conduit inlet to the outlet via said first and third flowpaths; and (b) during a ball freeing operation:

(i) the first blocking device is moved to a blocking position with respect to said first grid, and the pivotal comb is pivoted in a first direction to move its first section to an unblocking position with respect to the first section of the fixed comb, and to move its second section to a blocking position with respect to the second section of the fixed comb, thereby closing the first and third flowpaths and opening the second flowpath such that the balls tending to accumulate on said grid structure are moved closer to the outlet of said separator conduit;

(ii) the pivotal comb is then pivoted in the opposite direction back to its initial position, to thereby move its first section back to a blocking position with respect to the first section of the fixed comb, and its second section back to an unblocking position with respect to the second section of the fixed comb, thereby tending to move the balls accumulating on the upstream face of the fixed comb towards the outlet of the separator conduit; and (iii) the pivotal comb is then pivoted in said first direction to move its first section into unblocking position with respect to the first section of the fixed comb, and its second section to a blocking position with respect to the second section of the fixed comb, and the first blocking device is moved to its unblocking position with respect to said first grid, whereby the balls tending to accumulate on the upstream face of the second section of the fixed comb are moved closer to the ball outlet of the separator conduit.

7. The system according to claim 5, wherein said two sections of the fixed comb are coaxial, whereas said two sections of the pivotal comb form an angle of less than 180° between them.

8. The system according to claim 3, wherein said pivotal comb is pivoted by a piston.

9. The system according to claim 2, wherein said first blocking device is moved to its blocking or unblocking position by a piston.

10. A cleaning system for cleaning fluid-conducting tubing comprising:

a plurality of balls circulated with the fluid through the tubing from an upstream side to a downstream side of the tubing;

recirculating means having an inlet at a negative fluid pressure at the downstream side of the tubing, and an outlet at a positive fluid pressure at the upstream side of the tubing for recirculating the balls through the tubing;

a conduit having an inlet connected to the downstream side of the tubing, a ball outlet connected to the inlet of the recirculating means, and a fluid outlet connected to an outlet fluid line;

a first grid extending across a part of the interior of the conduit and defining a first flowpath to said conduit outlet, and a second grid extending across another part of the interior of the conduit and defining a second flowpath to said conduit outlet in parallel to said first flowpath;

a first blocking device movable to a blocking position to block the fluid flow through said first grid during a ball freeing operation, or to an unblocking position to unblock the fluid flow through said first grid during a normal cleaning operation;

and a second blocking device movable to a blocking position to block the fluid flow through said second grid during a normal cleaning operation, or to an unblocking position to unblock the second grid during a ball freeing operation.

11. The system according to claim 10, wherein said first blocking device is a closure plate pivotal at one side of said first grid either to an unblocking position or to a blocking position with respect thereto.

12. The system according to claim 10, wherein said second grid includes a fixed comb having a plurality of spaced teeth extending across the interior of the conduit, and said second blocking device includes a pivotal comb having a plurality of spaced teeth movable, when in its blocking position, into the spaces between the teeth of the fixed comb, and out of said spaces when in its unblocking position.

13. The system according to claim 12, wherein:

said fixed comb includes a first section and a second section closer to said ball outlet than said first section;

and wherein said pivotal comb includes a first section cooperable with said first section of the fixed comb to block the flow therethrough during a normal cleaning operation, but to permit the flow therethrough during a ball freeing operation, and a second section cooperable with the second section of the fixed comb to permit the flow therethrough via a third flowpath to the output fluid line during a normal cleaning operation, but to block the flow therethrough during at least a part of a ball freeing operation.

14. The system according to claim 13, wherein said first blocking device and said movable comb are controlled such that:

(a) during a normal cleaning operation, the first blocking device is in its unblocking position with respect to said first grid, the first section of the pivotal comb is in a blocking position with respect to the first section of the fixed comb, and the second section of the pivotal comb is in an unblocking position with respect to the second section of the fixed comb, whereby the fluid flows from the separator conduit inlet to the outlet via said first and third flowpaths; and (b) during a ball freeing operation:

(i) the first blocking device is moved to a blocking position with respect to said first grid, and the pivotal comb is pivoted in a first direction to move its first section to an unblocking position with respect to the first section of the fixed comb, and to move its second section to a blocking position with respect to the second section of the fixed comb, thereby closing the first and third flowpaths and opening the second flowpath such that the balls tending to accumulate on said first grid are moved closer to the outlet of said separator conduit;

(ii) the pivotal comb is then pivoted in the opposite direction back to its initial position, to thereby move its first section back to a blocking position with respect to the first section of the fixed comb, and its second section back to an unblocking position with respect to the second section of the fixed comb, thereby tending to move the balls accumulating on the upstream face of the fixed comb towards the outlet of the separator conduit; and (iii) the pivotal comb is then pivoted in said first direction to move its first section to an unblocking position with respect to the first section of the fixed comb, and its second section to a blocking position with respect to the second section of the fixed comb, and the first blocking device is moved to its unblocking position with respect to said first grid, whereby the balls tending to accumulate on the upstream face of the second section of the fixed comb are moved closer to the ball outlet of the separator conduit.

15. The system according to claim 13, wherein said two sections of the fixed comb are coaxial, whereas said two sections of the pivotal comb form an angle of less than 180° between them.

16. The system according to claim 12, wherein said pivotal comb is pivoted by a piston.

17. The system according to claim 10, wherein said first blocking device is moved to its blocking or unblocking position by a piston.

* * * * *